United States Patent [19]

Gach

[11] Patent Number: 4,651,885

[45] **Date of Patent: * Mar. 24, 1987**

[54] TAMPER INDICATING DISPENSING CLOSURE (FOR EDIBLE OILS)

[75] Inventor: Peter P. Gach, Evansville, Ind.

[73] Assignee: Sunbeam Plastics Corp., Evansville, Ind.

[ * ] Notice: The portion of the term of this patent subsequent to Feb. 24, 2003 has been disclaimed.

[21] Appl. No.: 636,251

[22] Filed: Aug. 13, 1984

[51] Int. Cl.[4] ..... B65D 51/22

[52] U.S. Cl. ..... 215/250; 220/258; 222/541

[58] Field of Search ..... 215/250, 31, 204, 253, 215/254, 256, 349, 350, 232, 250, 274, 276; 220/258, 265, 355, 85 SP, 356, 267; 222/541

[56] References Cited

U.S. PATENT DOCUMENTS

| | | | |
|---|---|---|---|
| 3,117,703 | 1/1964 | Henchert | 220/258 X |
| 3,135,441 | 6/1964 | Wise et al. | 220/258 X |
| 3,156,369 | 11/1964 | Bowes et al. | 215/250 X |
| 3,282,477 | 11/1966 | Henchert | 220/258 X |
| 3,404,811 | 10/1968 | Cerni | 222/541 X |
| 3,405,837 | 10/1968 | Carpenter, Jr. | 220/258 |
| 3,610,484 | 10/1971 | Matzka | 222/541 X |
| 4,359,169 | 11/1982 | Helms et al. | 220/258 |
| 4,378,892 | 4/1983 | Ochs et al. | 215/232 |
| 4,399,924 | 8/1983 | Nilsson | 220/258 X |

*Primary Examiner*—Steven M. Pollard
*Attorney, Agent, or Firm*—Irvin L. Groh

[57] ABSTRACT

A tamper indicating dispensing closure having a body member forming a dispensing passage at one end and an opening to receive the neck of a container at the other end in which the dispensing passage and opening in the neck are in communication with each other but are closed by a breakable foil seal element permanently attachable to both the closure and the container with which the closure is to be used. One end of the cylindrical body member of the closure is closed by a removable cap which gives access to the seal so that it can be ruptured to afford dispensing of the contents of the container.

14 Claims, 4 Drawing Figures

Fig-2
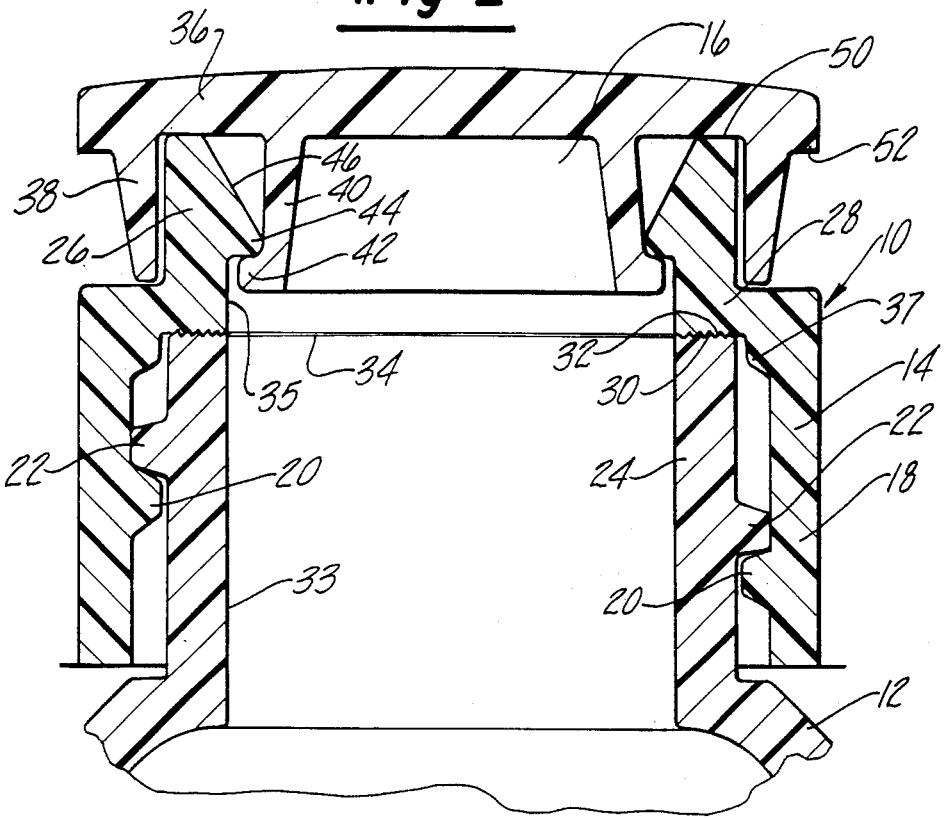
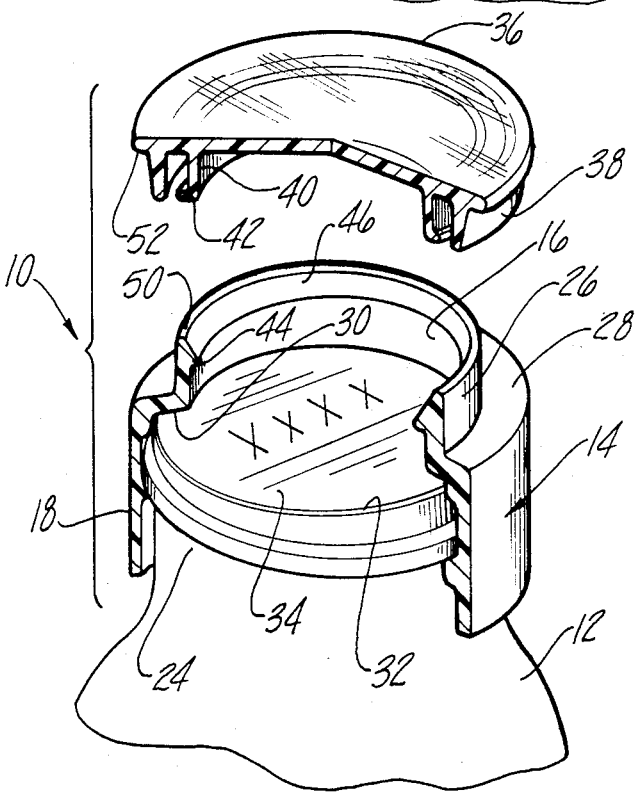
Fig-1

TAMPER INDICATING DISPENSING CLOSURE (FOR EDIBLE OILS)

This invention relates to closures and more particularly to tamper indicating dispensing closures.

In the packaging of some products, such as edible vegetable oils, it is highly desirable to provide a container and closure arrangement from which the product can be dispensed in small amounts and can be reclosed until the entire contents are used after which the container and closure are discarded. Such containers and closures should not be reusable. In addition, the arrangement must provide an effective seal not only to avoid leakage of the contents from the container but also to prevent the entry of air to assist in the preservation of the contents. It also is important, particularly when the contents of the containers are liquids, that the container remains in a tightly closed position, particularly during handling and shipment. Unfortunately, in many plastic packages in which the closure is threaded to the container, the closure tends to loosen after a period of time which can result in leakage and it therefore becomes desirable to provide means overcoming the problems of such loosening. An additional desirable feature, particularly in the packaging of edible products, is to provide tamper indicating features which give evidence of a prior opening of the container.

Such advantages are obtained when the present invention in which a tamper indicating dispensing package is in the form of a two-piece closure, one part of which is generally cylindrical and has an end closed by a cap and the other end is adapted to be threadably received by the neck of a container. A seal member is temporarily held in position within the cylindrical member and after the closure is applied to a container, the container is passed through an induction field to heat and fuse the seal element to permanently fasten it to both the cylindrical member and to the container to form an effective seal against the entry of oxygen and the leakage of liquid contents from the container. This also permanently attaches the container and threaded member to each other to obviate the problem of thread loosening. The cap closing one end of the cylindrical closure is transparent so that the condition of the seal can be observed by prospective purchasers to ascertain that there has been no prior opening of the container. Upon removal of the cap, the seal can be punctured and removed, after which the contents of the container can be dispensed through the cylindrical body member of the closure. The cap can be reapplied to the body member to close the dispensing passage after which the contents of the container can be viewed through the transparent cap. In one embodiment of the invention, the cap is held in spaced relationship to the body member by a tear band which must be removed in order to puncture the seal for dispensing contents of the container. The removal and absence of the tear band gives further evidence of tamper indicating. The underside of the cap is provided with a cutting edge which is maintained in spaced relationship to the seal element until after the tear band is removed. Thereafter, the cap can be pushed downwardly to puncture the seal for dispensing of the contents of the container.

Preferred embodiments of the invention are illustrated in the drawings in which:

FIG. 1 is an exploded, cross-sectional view of the tamper indicating dispensing closure and container embodying the invention;

FIG. 2 is a cross-sectional view at an enlarged scale showing the relationship of the closure and neck of the container prior to the first opening of the package;

Figure 3:
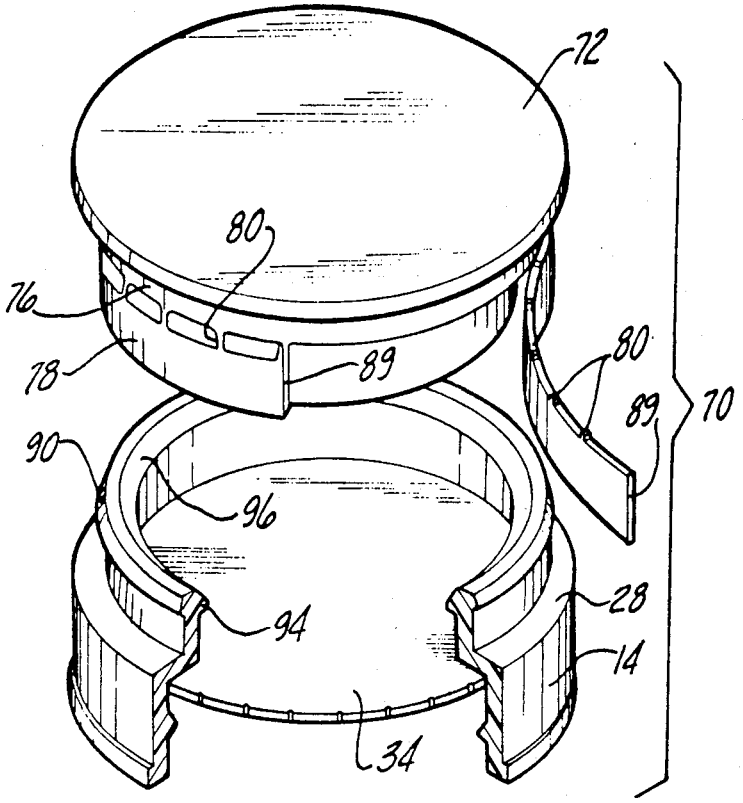
FIG. 3 is an exploded perspective view with portions removed and generally similar to FIG. 1 but showing another embodiment of the invention.

The tamper indicating dispensing closure embodying the invention is designated generally at 10 and is used in connection with a container 12, which is only partially shown.

The closure 10 includes a body member 14 which has an axially extending passage 16. The lower portion of the body member 14 is formed by a cylindrical skirt 18 which is provided with threads 20 that are engageable with external threads 22 on a neck 24 of the container 12.

The body member 14 has an upper cylindrical collar 26 which is joined to the cylindrical skirt 18 by an annular flange 28 having a sealing surface 30 in opposed relationship to a sealing surface 32 surrounding the open neck 24. The neck 24 forms an opening or passage 33 which is in alignment with the passage 35 formed in the cylindrical collar 26.

When the closure 10 is attached to the container 12, a seal element 34, in the form of a disc, is seated between the surfaces 30 and 32 on the body member 14 and neck 24. The seal element 34 is effective to completely close the opening 33 in neck 24 and the dispensing passage 35 in collar 26. Preferably, the seal element 34 is of a thin metal foil such as aluminum having its opposite sides coated with polymeric materials which are fusable with the body member 14 and the sealing surface 32 on the neck 24 of the container 12. The seal element 34 is fused to both the body member and neck by passing the filled container 12 with the body member 14 applied through an electrical induction field.

The seal element 34 may be temporarily assembled to the body member 14 by positioning it against the sealing surface 30 and retaining it in position by an annular bead 37.

The upper end of the body member 14 is closed by a detachable and replaceable closure cap 36 which is made of transparent and flexible plastic material. The cap 36 is provided with an outer annular skirt 38 which is concentric with an inner annular sealing flange 40. The lower end of the sealing flange 40 is provided with a radial sealing bead 42 which extends radially outwardly and is complementary to and engaged with a shoulder 44 formed at the underside of a pouring lip 46, the upper surface of which is flared axially and radially outwardly. In a closed position of the closure 10 on a container 12, the underside of the cap 36 engages an annular sealing surface 50 surrounding the pouring lip 46 and the sealing bead 42 engages the shoulder 44 for additional sealing.

In packaging operations, the container 12 can be filled with such products as edible vegetable oils and the container 12 can be closed by applying the entire tamper indicating dispensing closure 10, the assembly of which includes the body member 14, the cap 36 and the seal element 34. If preferred, the container 12 can be closed after it has been filled by applying only the body member 14 and the seal element 34. In either case, the container 12 is passed through an induction field and the seal permanently fuses and fixes the body member 14 to the neck 24 through means of the seal element 34. If only the body member 14 and seal 34 were applied, the transparent cap 36 can be subsequently applied by pressing it onto the body member. In that case, the sealing bead 42 engages the angled surface on pouring lip 46 until the sealing bead 42 snaps under the shoulder 44.

To obtain access to the contents of the container 12, it is necessary to remove the cap 36 which can be accomplished by prying upwardly on the overhanging flange 52 of the cap 36. This gives access to the seal element 34 which can be punctured or torn away to open the dispensing passage to permit pouring of the contents of the container 12. When only a portion of the contents of the container 12 are dispensed, the package can be reclosed by replacing the cap 36 by pressing downwardly until the sealing bead 42 snaps under the shoulder 44.

Prior to opening the package for the first time, the condition of the seal element 40 is visible through the transparent cap 36 to give notice to both the vendor and the vendee that there has been a prior opening of the package. For that purpose, it may be desirable to provide indicia or a message, such as the word "sealed", where the Xs appear on the seal element 34 as seen in FIG. 1.

The absence of such a message or a puncture in a seal will be readily apparent when compared with like packages in the same display. Moreover, the transparent cap 36, after the seal 34 has been removed, will make the contents of the container visible even when the container 12 is made of opaque material.

Although the body member 14 has been illustrated as employing complementary threads 20 and 22, the body member 14 could be attached to the container 12 in other known methods, for example, by interlocking flanges forming a snap connection.

Figure 4:
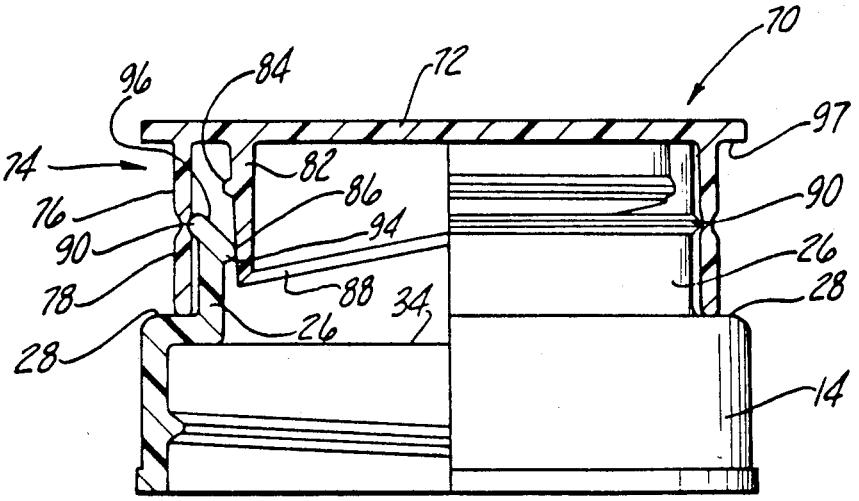
FIG. 4 is a cross-sectional view showing the relationship of the closure parts to the first opening of the closure.

Still another embodiment of the invention is illustrated in FIGS. 3 and 4. In this embodiment of the invention, a tamper dispensing closure 70 includes a body member 14 substantially identical to the body member used with the tamper indicating dispensing closure 10 and incorporates a seal element 34 for permanent attachment to the neck of a container. The cap 72 differs from the cap 36 of the prior embodiment in that the skirt 74 is made up of an upper annular portion 76 and a lower annular portion 78. The portions 76 and 78 are attached to each other by frangible portions 80 which form an annular line of weakening by which the lower portion 78 may be grasped and torn away. The lower portion 78 of the skirt 74 engages the flange 28 on the body member 14 to maintain the cap 72 in a predetermined spaced relationship to the seal element 34.

The underside of the cap 72 is provided with an annular sealing flange 82 provided with an annular sealing bead 84 similar to the sealing bead 42 in the embodiment in FIGS. 1 and 2. The lower end of the sealing flange 82 is provided with a cutting portion 86 having a cutting edge 88 disposed at an angle to a plane normal to the axis of the cap.

In the assembled condition of the cap 70 with the body member 14, and cap 72 in position relative to each other, a lip 90 projects radially outwardly a slight amount from the collar portion 26 to fit into a recess formed at the juncture between the upper portion 76 and lower portion 78 of the skirt 74. The lower portion 78 also engages the top of the flange 28 so that the cap 72 is held in position relative to the body member 14 and seal 34 with the cutting edge 88 in spaced relationship to the top of the seal 34.

When it is desired to use the closure and to dispense the contents from the container with which the closure is used, the tear band or lower portion 78 of the skirt 74 is removed by tearing it away. To facilitate removal, the band 78 is provided with abutting ends 89 seen in FIG. 3. This causes the frangible points 80 to break and band portion 78 to separate from the portion 76. With the band 78 removed, the cap 72 is pushed downwardly during which time the cutting edge 78 at its lower most point begins to puncture the seal element 34 with such puncturing continuing as the cap 72 moves downwardly. Such movement can continue until the annular sealing bead 84 engages under a radially inwardly projecting portion 94 of the pouring lip 96. The relationship of the sealing bead 84 and the inwardly projecting portion 94 will then be generally similar to that of the sealing bead 42 and shoulder 44 in the prior embodiment of the invention. Thereafter, the cap 72 may be removed by lifting on the overhanging portion 97.

In the embodiment of the invention as seen in FIGS. 3 and 4, not only does the punctured sealing element 34 give evidence of tampering, but the removal of the tear band 78 gives a comparison with other containers to indicate that there has been a prior opening of the closure.

As in the prior embodiment of the invention, the cap 72 may be made of transparent material so that the condition of the seal 34 is visible prior to the first opening and once a container has been opened, the contents of the container may be viewed through the transparent cap 72.

The embodiments of the invention in which an exclusive property or privlege is claimed are defined as follows:

1. A tamper indicating dispensing package comprising: a container having a neck defining an opening; a closure including a cylindrical body member forming a passage extending therethrough, a cap detachably connected to one end of said cylindrical body member to close said passage, said body member being connected at its other end to said container neck; a destructable and removable seal element extending across said passage adjacent to one side of said cap when said cap is attached to said body member, said seal element being disposed between said body member and the neck of said container and being fused to said body member and said container thereby forming a permanent connection between said body member and said container, and said cap being removable to give access to said seal for removal or rupture to give access to the contents of said container through said passage.

2. The tamper indicating package of claim 1 wherein said closure is transparent to make said seal element visible when said cap is in a closed position on said body member.

3. The tamper indicating package of claim 1 and further comprising means temporarily holding said body member on the neck of said container prior to fusing said seal element to said body member and neck permanently connecting said body member to said container.

4. The tamper indicating package of claim 3 wherein said means are complementary threads on said body member and said neck of said container.

5. The tamper indicating package of claim 3 wherein said means are complementary snap beads on said body member and said neck of said container.

6. The tamper indicating dispensing package of claim 1 wherein said one end of said passage forms a pouring lip for materials dispensed through said passage.

7. The tamper indicating dispensing package of claim 6 wherein said pouring lip projects radially inwardly of said dispensing passage and wherein said cap has an annular collar member engageable with said radial projection to hold said cap in closed position on said body member.

8. The tamper indicating dispensing package of claim 1 wherein said body member has a stepped passage and wherein said other end is disposed on the exterior of a neck of a container and its one end is in substantial alignment with the opening in a container.

9. A tamper indicating dispensing closure for containers comprising: a body member adapted for attachment to a container having a first opening; said body member forming a second opening aligned with said first opening; a seal element disposed between said body member and said container and disposed between said openings; a cap detachably attached to said body member to close said openings, said cap being removable to give access to said seal element; said seal element being destructable to place said first and second openings in communication with each other for dispensing contents of said container, and means maintaining said cap in spaced relationship to said seal element, said means being removable to permit axial movements of said cap relative to said body member to puncture said seal element and place said first and second openings in communication with each other.

10. The tamper indicating dispensing package of claim 1 wherein said seal element includes a metallic layer to facilitate heating and fusing of said seal element to said container and said body member.

11. The tamper indicating dispensing closure of claim 9 wherein said cap is in the form of a stopper engageable with an internal surface of said second opening.

12. The tamper indicating dispensing closure of claim 9 wherein said body member forms a pouring lip around the circumference of said second opening, said stopper having an outwardly directed sealing bead coacting with a shoulder formed as part of said pouring lip to hold said cap in closed position on said body member.

13. The tamper indicating dispensing closure of claim 9 wherein said means maintaining said cap in spaced relationship to said seal element is a tear band extending circumferentially around the base of said cap and engageable with said body member to prevent axial movement of said cap toward said body member.

14. A tamper indicating dispensing closure of claim 9 wherein said cap is transparent to make said seal element visible when said cap is in spaced relationship to said seal element and to permit the contents of a container with which the cap is used to be visible after said closure has been opened for the first time.

* * * * *